United States Patent [19]

Leghorn

[11] 3,930,532

[45] Jan. 6, 1976

[54] CONTINUOUS CENTRIFUGAL TUBE CASTING APPARATUS WITH DRY MOLD AND GAS PRESSURE DIFFERENTIAL

[76] Inventor: George R. Leghorn, 1423 Washington Ave., Apt. 1, Santa Monica, Calif. 90403

[22] Filed: Sept. 15, 1971

[21] Appl. No.: 180,927

Related U.S. Application Data

[60] Division of Ser. No. 769,017, Oct. 21, 1968, Pat. No. 3,605,859, which is a continuation-in-part of Ser. No. 538,506, Feb. 11, 1966, Pat. No. 3,445,922.

[52] U.S. Cl. ..... 164/273 R; 164/298

[51] Int. Cl.[2] ..... B22D 13/02

[58] Field of Search ..... 164/64, 84, 254, , 273 R, 164/298

[56] References Cited

UNITED STATES PATENTS

| | | | |
|---|---|---|---|
| 1,377,372 | 5/1921 | Thompson | 164/254 |
| 1,444,953 | 2/1923 | Crane | 164/84 |
| 1,527,729 | 2/1925 | Dunajeff | 164/298 X |
| 2,707,813 | 5/1955 | Dickson | 164/85 X |
| 3,367,400 | 2/1968 | Hathorn | 164/84 X |
| 3,416,591 | 12/1968 | Babel et al. | 164/85 |

*Primary Examiner*—R. Spencer Annear

[57] ABSTRACT

The invention pertains to the continuous centrifugal casting of metallic and non-metallic tube onto the I.D. surface of a rotating hollow cylinder which acts as the initial mold of the tube forming operation. Molten material, to be cast to tube, is continually introduced into the entrance end of the centrifuge and the solidified centrifugally cast tube is continuously extracted from the exit end. The process is greatly enhanced as to casting rates and ease of extraction of the solid cast tube by the techniques of utilizing a vacuum on the interior of the tube, in its molten and solid state, and/or a positive pressure (above ambient) external to the solidified or partially solidified tube at the exit end of the centrifugal casting machine.

8 Claims, 7 Drawing Figures

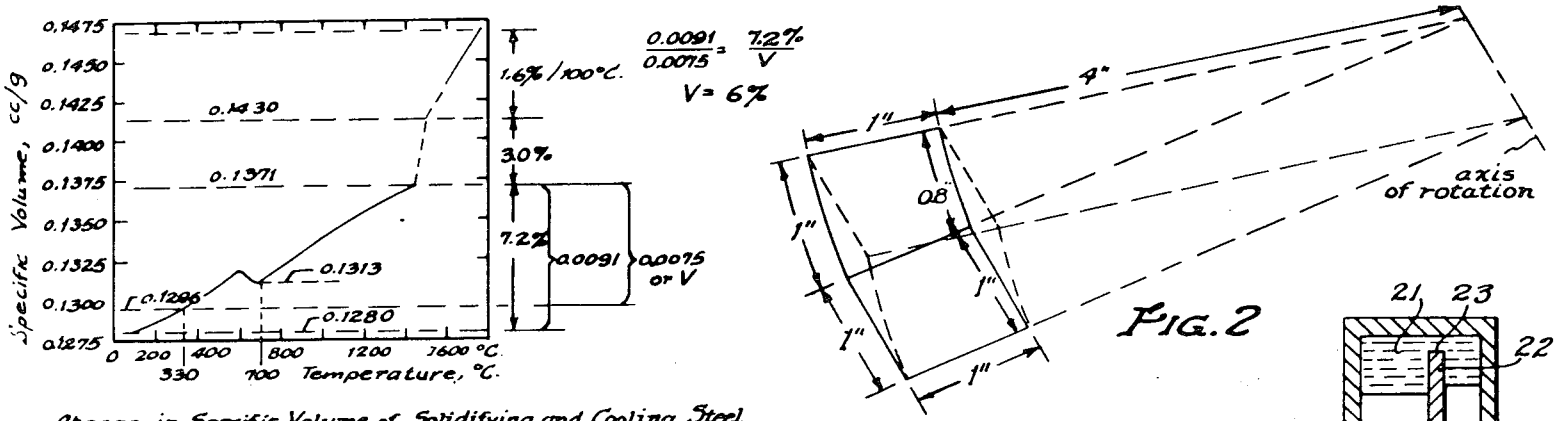
FIG. 1
Change in Specific Volume of Solidifying and Cooling Steel
FIG. 2
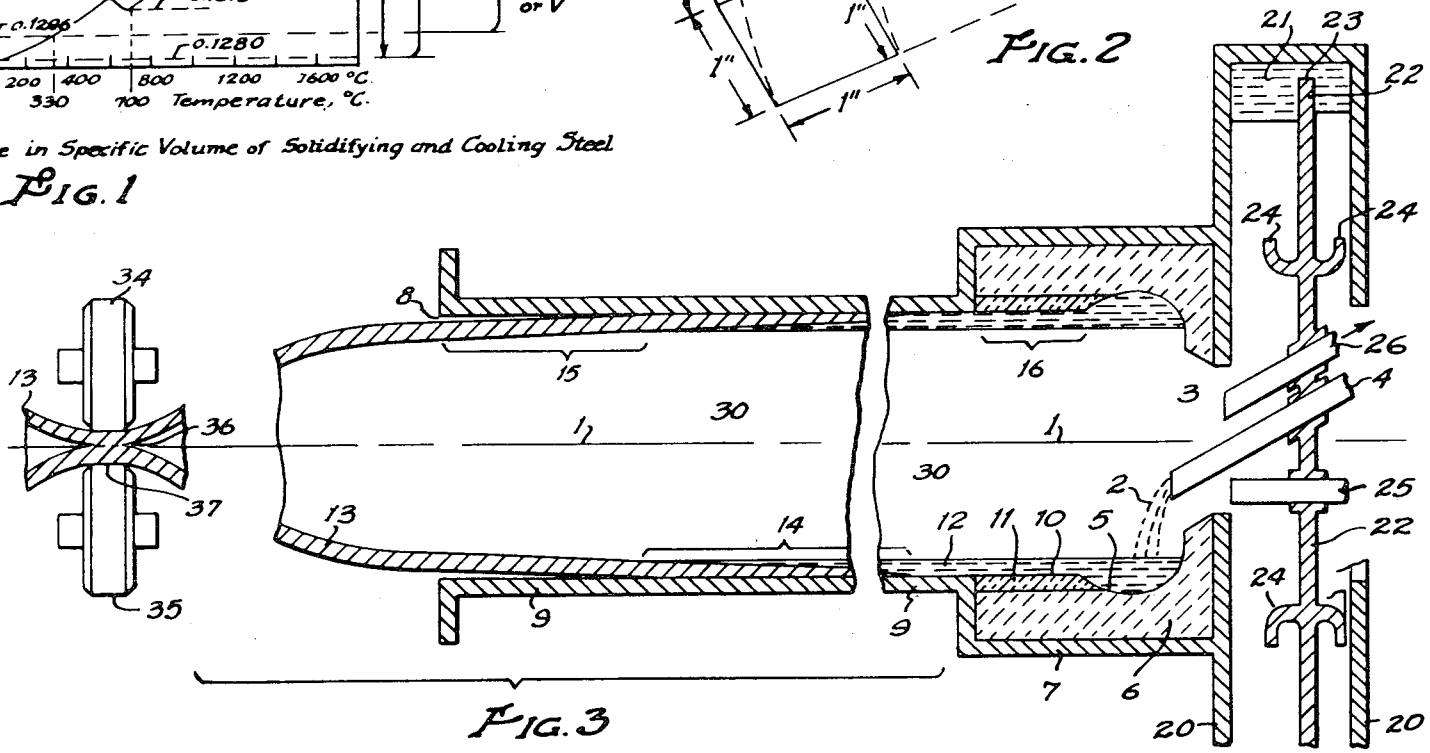
FIG. 3

CONTINUOUS CENTRIFUGAL TUBE CASTING APPARATUS WITH DRY MOLD AND GAS PRESSURE DIFFERENTIAL

GRAVITY SEGREGATION

One of the limitations encountered in centrifugal casting concerns the centrifuging of denser constituents towards the outside surface (and, conversely, lighter constituents towards the interior surface) by the high "G" centrifugal forces. Under normal, fairly rapid, solidification this is no problem but it is sufficiently severe in some alloy systems as to obviate or limit the use of centrifugal casting. The variation of composition from the interior to the exterior surface of a centrifugal casting is termed gravity segregation and has been considered as either a limitation or a nuisance by centrifugal casters.

It is a purpose of this invention, and one of the teachings disclosed herein, to enhance and utilize gravity segregation to a useful purpose.

The specific method of accomplishing or enhancing gravity segregation to effect a useful purpose is to introduce an extended-hot-zone at the starting end of the continuous centrifugal casting system herein disclosed. The Maxim process has a hot zone at the starting end of the caster for the purpose of preventing a knobby surface (to enhance the leveling or smoothing action) and another invention, U.S. Pat. No. 2,754,559 issued to Fromson in 1956, utilizes an initial hot zone to enhance layering of smooth spreading out of the molten metal to be solidified on top of a flat liquid mold of lead. In the process disclosed herein, the hot zone is appreciably extended (where desired to enhance gravity segregation and only in this instance is the hot zone so extended beyond that required for effective leveling or layering of the molten steel) so that segregation will be emphasized and can be utilized usefully as will be explained in detail later on.

Automotive sheet steel (used for the exterior body covering), is normally made from rimmed-steel ingots even though it would be considerably cheaper, if the desired properties were present, to utilize continuously cast slabs or billets instead of remaining with the old ingot process. The reason for this is that rimming-steel exhibits a vigorous boiling action on pouring into the ingot mold and this creates a scrubbing action at the solidifying surface of the ingot. The result is that rimmed-steel ingots have a fine grained exterior layer of fairly low carbon content. When such ingots are rolled, the surface of the sheet is smoother and takes a better polish than steel made by other processes. It also has better deep drawing qualities. The spattering (which creates a rim on the ingot mold and is the basis for the term rimmed-steel) caused by the release of gases, with resultant vigorous boiling action, is the main reason that rimmed steel cannot be effectively cast by current continuous casting processes.

Rimming-steel can be cast in the centrifugal process using a mold having a fairly large diameter (as 3 feet) since any spattering merely ends up on the opposite interior surface of the tube and is not oxidized due to the internal inert vacuum. The scrubbing action is absent, however, since the released gases are directed inwardly by the centrifugal forces. Centrifugally cast steel does, however, have the required density since it is pressure cast under optimum conditions.

If, however, an extended-hot-zone is used, either with rimming steel or with semi- or fully- killed low carbon steel, the delta ferrite (essentially pure iron) solidifys first and, being solid and denser than the balance of the molten metal, centrifuges to the exterior surface. The resultant centrifugally cast tube is characterized by having an exterior layer of dense, fine grained, low-carbon steel. Such a tube can be collapsed to a plate and roll-welded on its interior contiguous surfaces to yield a product capable of being rolled to sheet stock which exhibits all of the properties (smooth surface, high polish-ability, and deep drawing characteristics) required of automotive sheet stock. Such a tube can also be slit longitudinally and flattened to plate stock, by prior art processes, and rolled to sheet having the desired properties on one (the tubes exterior) surface.

It can be appreciated that such automotive sheet stock can also be produced from batch-type centrifugally cast cylinders of steel by the expedient of an extended (slow) cooling action using pre-heated or low heat conductivity molds of a solid wall nature.

The extended-hot-zone is basically a means of slowing the solidification rate over a specific temperature range. With low-carbon steel this range coincides with the delta-ferrite region of the iron-carbon phase diagram which encompasses the temperature range of about 1500° to 1475°C.

The extended-hot-zone (slowed solidification range) can, by intentionally varying the length of the hot-zone or utilizing higher G forces, create a wide variation of surface properties in collapse-formed sheet products made from such tube. Ordinarily, the extended-hot-zone is used only where an end product of uniquely advantageous properties is created (as automotive sheet stock). The hot zone is restricted to that necessary for leveling or smoothing of the molten steel or other material layer under all other conditions. This is especially true where the tube is to be longitudinally collapsed-formed to a structural item (as I-beam or railroad rails) where a lower carbon surface could result in a loss of fatigue resistance.

Other alloys can be advantageously processed by the technique of using an extended-hot-zone. Cast iron pipe continuously centrifugally cast from gray or nodular irons can be produced with a gradient metallurgical structure (from the exterior to interior surface of the pipe) of varying carbon content which exhibit advantageous properties under certain conditions of use. Silicon steels can be so treated to produce a high-silicon interior surface on the centrifugally cast tube.

FIG. 1 is a graphical representation of the change in specific volume of a solidifying and cooling steel;

FIG. 2 is a geometrical sketch of a truncated wedge section hypothetically removed from the cast tube for illustrative purposes;

FIG. 3 is a partial axial sectional view of a horizontal centrifugal solid-wall continuous tube casting machine with seal means at the entrance and exit ends thereof;

Figure 6:
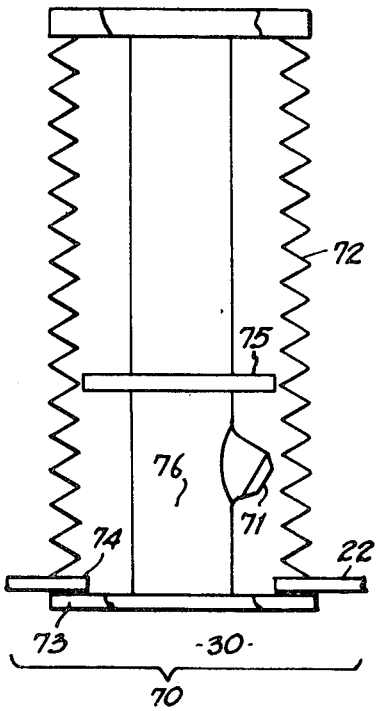
FIG. 6 is a partial axial sectional view of a plasma torch arrangement, utilizing a bellows vacuum seal, in the retracted position.

FIG. 6 A is a similar view of the plasma arrangement in the extended position.

DETAILED DESCRIPTION — THE PROCESS

Referring now to the drawing in detail, and in particular to FIG. 1 (redrawn from Wulff's "Metallurgy for Engineers") it can be seen that a centrifugally cast mild steel tube will experience a volume shrinkage of about 6% or a diametrical shrinkage of 2% in cooling from the solidification temperature of about 1500°C to a temperature of about 330°C under centrifugal casting conditions. It can also be derived that the diametrical shrinkage of a centrifugally cast mild steel tube in cooling from 1500°C down to 700°C is about 1.5%. The specific volume contraction curve of FIG. 1, illustrates the amount of shrinkage attendant to the cooling of a mild steel casting under normal or static conditions and is reproduced herein for information purposes.

FIG. 2 is illustrative of a solid geometrical configuration wherein a sq. in. area on the periphery of a 10 in. diameter tube, having a 1 in. wall thickness, is radially projected inwardly onto the axis of the tube to form a truncated wedge within the confines of the radial projection lines and the exterior and interior surfaces of the tube wall. The projection of the 1 in. sq. area on the exterior surface of the tube onto the tube's axis cuts out a rectangular area on the interior surface of the tube that is 1 in. long and has a circular length of 0.8 in. on the adjacent side. The inner rectangle has an area of 0.8 × 1 or 0.8 sq. in. The volume of the truncated wedge is, therefore, 0.9 cu. in. and this volume bears on the 1 sq. in. of exterior tube surface under the influence of the centrifugal action. The geometrical configuration is used to illustrate the decrease of volume bearing on the O.D. surface of a tube as the diameter becomes smaller and the corresponding decrease in bearing pressure (psi).

In the following drawings pertaining to continuous centrifugal casting machines and devices, such means as cooling of the mold, tube withdrawal techniques, trunnions, bearings, rotational mechanisms, and the like which are well known to the prior art, are not shown and have been omitted for the sake of brevity.

Reference is now made to FIG. 3 which is an axial cross-sectional view of a horizontal solid-wall continuous centrifugal casting machine which rotates about its axis 1. The molten material 2 to be cast to tube, is continuously introduced into the entrance end 3 via the conduit 4 and pours into the annular distributing trough 5 of the refractory part 6. The refractory part 6 is encased in a structural metal housing 7 which extends towards the exit end 8 of the centrifuge as the solid mold wall 9 the exterior surface of which is cooled by a multiplicity of peripherally spaced jets of cooling liquid (not shown). The molten material 2 overflows the ledge 10 which is lined with an annular ring 11, of axially aligned pyrolytic material for rapid axial heat conduction and radial insulation and constitutes a hot zone 16) and forms an axially flowing ring of molten material 12 which freezes to a solid tube 13 by heat conduction to the mold wall 9 in area 14 and by radiation to the blackened mold wall interior in area 15. At the entrance end 3 of the centrifuge and axially external to the refractory part 6 is an annular trough 20 which is partially filled with a centrifuged heavy liquid 21 of a high boiling nature (as Wood's metal, molten tin or lead, etc.). A non-rotating end plate (disc) 22 has its outer periphery 23 immersed in the annular trough fluid 21 and constitutes a vacuum seal for the casting machine at its entrance end 3. The end seal disc 22 has circumferential gutters 24 which collect any cascading fluid 21 and return it to the trough 20 at the bottom side. The molten material conduit 4 as well as an inert gas purge tube 25 and a vacuum suction line 26 extend through the end plate 22 and are attached thereto by leak-proof seals. By means of the purge tube 25, the cavity 30 of the tube's interior is purged with an inert gas and a vacuum is then drawn on the interior cavity 30 via vacuum tube 26. The diameter of the trough 20 is considerably greater than the diameter of the centrifuge and the diameter of the liquid level of the sealing material is also quite large. By this means, greater access area (via sealed but removable port holes) is available in the end plate 22 for insertion of required mechanisms such as plasma torches, rotary skimming devices, etc., as needed. The trough 20 is deep enough to contain all of the seal fluid 21, without overflow, when rotation is stopped.

Exterior to the exit end of the centrifugal casting machine is a set of opposed forging rolls 34 and 35 which travel axially and in synchronizm with exiting tube 13. At the same axial location and at right angles to the plane between the axis of the forging rolls (34 and 35) are two opposed banks of burners such as plasma torches (not shown) which maintain the heat of the exiting tube 13, or bring it to a desired forge-welding temperature. These forging rolls 34 and 35 move synchronously and axially along with the hot tube and gradually come together with sufficient force to collapse a small portion of the tube (as a 2 ft. length) to a solid round having a forge welded interior joint 36 which is vacuum-tight. Such collapsed sections of the tube can be as far apart as desired (e.g., every 300 ft. of tube length) and comprise the vacuum seal to the tube at the exit end of the centrifugal caster. Further on, and after another seal has been so forge-closed, the solid section 36 can be cut off at its mid-length for removal of the discrete length of vacuum sealed sausage-like tube lengths, for use as previously described. It can be appreciated that other conventional means, such as swaging, flat-crimping, etc. can be used to form the discrete collapsed section for vacuum closure at point 37 of the hot tube. Also, axial travel of the sealing rolls (34 and 35) can be extended (as to 300 plus feet) so that they act as powered pull-out grips for the tube so cast. The tube can also be sealed at the exit end by continuous collapse-deformation thereof to longitudinal items of structure in accordance with the teachings of my prior patent application Ser. No. 538,506.

By means of the forged tube closure 36 and the end plate seal 22, a vacuum can be drawn (via conduit 26) on the tube cavity 30 to an extent that it partially or completely counterbalances the side-wall force and resulting friction of the tube being cast in accordance with Method 4.

It should be noted that the hot zone 11 can be lengthened beyond that necessary for ring layering 12 so as to create an extended-hot zone 16 so that slow cooling of the molten tube can be accomplished. In this manner, when desired, accentuated gravity segregation results (e.g., delta ferrite being centrifuged towards the outside surface of a mild steel tube which is later to be converted to automotive sheet steel).

Figure 4:
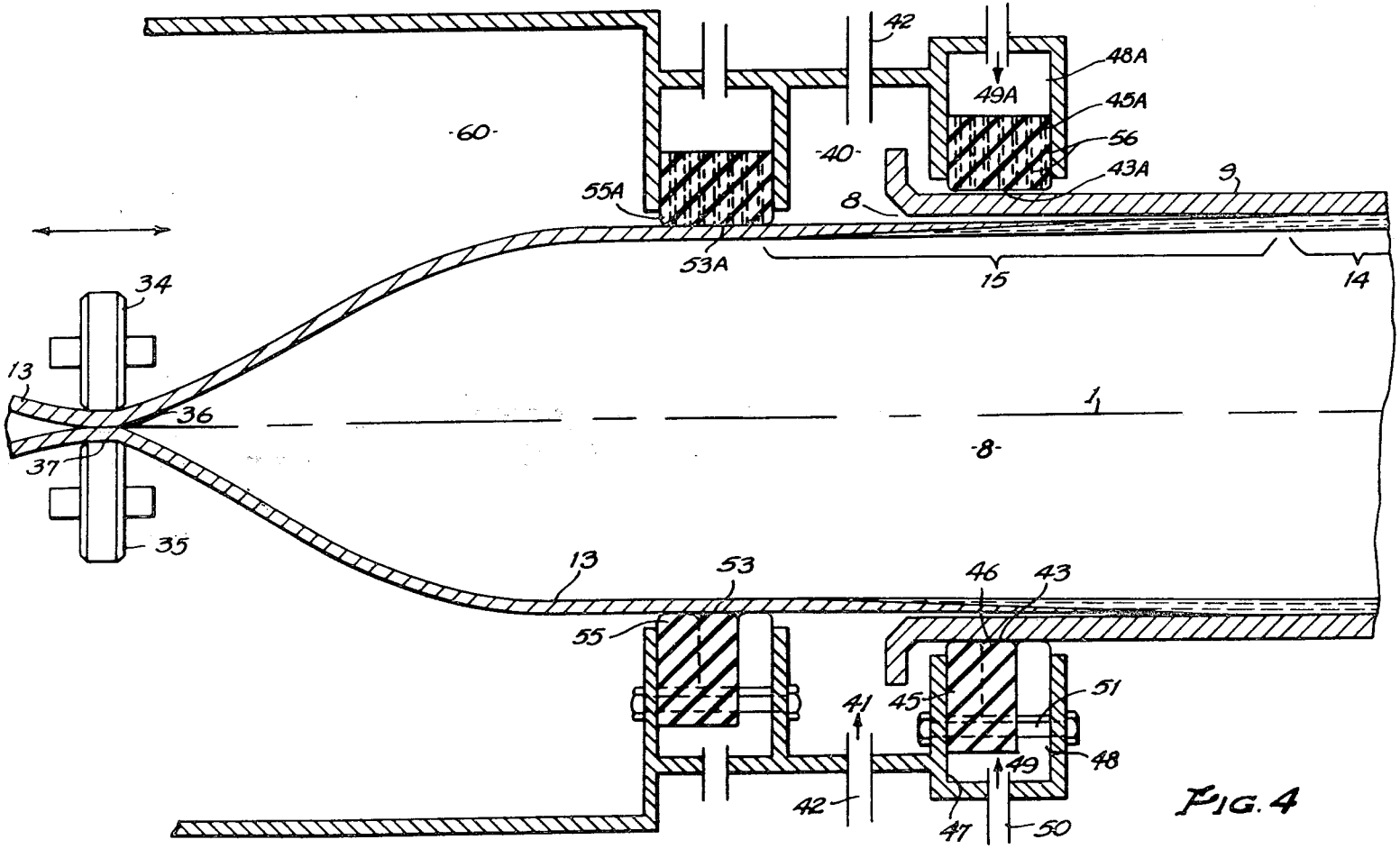
FIG. 4 is an axial sectional view of an embodiment of the exit end of a solid-wall centrifugal tube casting machine which depicts means of enclosure thereat to effect a positive pressure (above ambient) external to the exiting tube as per Method 5.

FIG. 4 is an axial sectional view of the exit end 8 of another horizontal solid mold centrifugal tube castor and is illustrative of the annular end closure 40 utilized in the application of Method 5.

In FIG. 4, the collapsing and forge welding rolls 34 and 35 have already been described as a means for sealing the tube 13. Whereas the tube 13 and the mold 9 are rotating, the annular end closure 40 is stationary. An inert or reducing gas 41 (inert is a relative term since a gas such as carbon dioxide, which is oxidizing to hot steel, is practically inert to hot aluminum and can be so used in the casting of aluminum tube) is introduced into the end closure 40 via the high pressure gas tube 42 and the pressurized gas 41 acts on the outer surface of the tube (both exterior to the exit end and in the shrinkage gap between the tube and the mold wall of the centrifuge) and supports it (counteracts the centrifugal weight of the tube wall) to a desired extent. The end closure 40 is sealed at the annular area 43 (on the O.D. of the centrifugal caster of its exit end 8) by means of an iris ring 45 of carbon, graphite, or boron nitride leaves 46 which overlap each other (as camera iris blades do) to form an annular ring 45 of such blocks (leaves) in friction contact with the O.D. of the mold wall at area 43. The iris ring 45 is contained within an annular groove 47, the opening of which faces inwardly, and this groove encompasses a pressure chamber 48 (radially exterior to the iris ring 45) which is pressurized by an inert gas 49 introduced via conduit 50. A multiplicity of iris leaves 46 make up the iris ring 45 and these leaves are each attached at one end to the groove 47 by means of pivot pins 51.

At the other side of the pressurized enclosure 40 and at area 53 on the O.D. of the tube 13 is another similar iris ring 55 which seals the enclosure 40 at the surface of the exiting tube 13. Such iris rings as described, are not the preferred means of sealing the enclosure 40 since they exert a considerable wiping force and wear at a fairly high rate. The preferred means is to utilize an annular iris seal ring 45A which is much the same as that of 45 except for a multiplicity of small radial holes 56 which exist over the entire iris ring 45A and conduct a high pressure inert gas 49A onto the outer surface of the mold wall 9 at area 43A. In this manner, the iris ring 45A acts as a gas bearing and does not actually contact the rotating surface of the mold. Due to this, wear of the iris ring 45A face areas is eliminated and the escaping gas of the bearing face maintains the desired pressure of the enclosure 40. The iris ring 55A which seals against the rotating tube's O.D. surface at area 53A can also utilize the gas bearing technique; however, it is sometines preferred to use a liquid bearing at the area 53A for the following listed purposes:

1. A heat extractive coolant of a non-oxidizing nature (as a mixture of water and methyl alcohol). Such liquid bearings can also be used to cool the exterior surface of the mold wall 9.

2. As a quenchant (as a brine plus a suitable reductant) for the purpose of hardening the tube for use as heat-treated pipe. In this instance, the forge welded closures at point 37 would be normalized and subsequently removed from the pipe. The balance of the quench hardened pipe would be tempered to a desired hardness and strength level prior to removal of the forge welded ends and breaking of the internal vacuum.

3. A liquid bearing of lead, tin, zinc, aluminum, etc., or desired alloys thereof (as lead-tin) would be used (in the molten state) where an exterior coating of such metals is desired for corrosion protection of the pipe. Coincidentally, a steel tube could be heat-treated by austempering with such molten metal liquid bearings.

Where liquid or gas bearing irises 43A or 53A are used for sealing the end closure 40 and centering the exiting tube 13, the iris blocks (leaves) 45A and 55A can be made of other materials such as copper, steel, alumina, or other non-metallic materials, etc. since they do not have a friction contact with the outer surfaces of the mold 9 or the tube 13.

Figure 5:
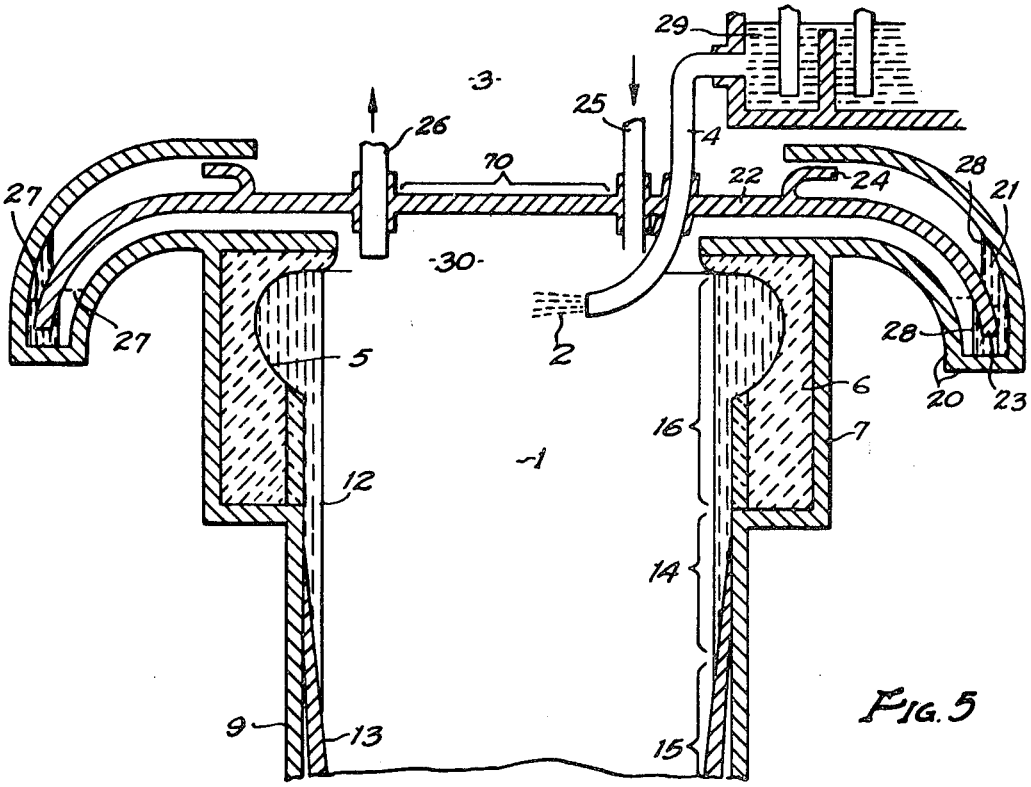
FIG. 5 is a partial axial sectional view of a vertical centrifugal solid-wall continuous tube casting machine with seal means at the entrance end thereof.

FIG. 5 is a representation of a starting end 3 vacuum end seal for a vertical continuous centrifugal tube casting machine (as of the type depicted in British Pat. No. 984,053 or other) and is presented as a partial axial cross-sectional view.

In FIG. 5, the axis 1 of the centrifuge is vertical and the molten material, to be cast to tube 13, is introduced into an annular distributing trough 5 via conduit 4. The molten material 2 is sluiced horizontally so that its direction of flow has tangential coincidence with the rotational motion of the molten material 12 in the distributing trough 5. The cavity of the molten and solidified tube 13 contains a partial vacuum (Method 4) of inert gas by virtue of being sealed beyond its exit end (not shown) by the inward collapse and forge welding of a discrete section of the exiting tube 13 and, at its entrance end 3, by a non-rotating seal plate (dish) 22 which has its periphery 23 immersed in a dense high-boiling liquid 21 (as Wood's metal, cadmium, lead, tin and alloys thereof) contained in an annular trough 20. The convex side of the seal plate (dish) 22 has an annular gutter 24 which inhibits access of air to the molten metal 21 of the seal and, also, prevents any inadvertent escape of fluid from the trough. Under non-rotating (stop periods) conditions, the liquid levels of the fluid 21 are as shown by dotted lines 27 while, under the centrifugal forces of casting, the liquid levels of the fluid 21 assume the positions shown by the vertical lines 28. It can be appreciated that the periphery 23 of the dished end plate 22 is always immersed in the fluid 21, whether the centrifugal caster is operating or not, to form an effective vacuum seal. Such orifices in the end plate 22 as the purge tube 25 and the suction tube 26 are the same as in FIG. 3 and the other numbered points (not discussed herein) are the same as in FIG. 3 except for the vertical attitude. The molten material 2 enters the conduit 4 by way of a conventional trap 29 as a means of maintaining the vacuum within the internal cavity 30.

The central area 70 of the end plate 22 is reserved for other entrance ports as required in such a system (as the vertical water-cooled shaft, which is an extension of the rotary mandrel used in the vertical centrifugal tube casting machine disclosed in British Pat. No. 984,053; or, the bellows encased plasma torch of the following FIGS. 6 and 6A).

The exit end 8 end closure 40 as shown in FIG. 4 is also used in the application of Method 5 to the vertical system although not shown since it would vary but slightly from that already disclosed.

It can be realized that the straight sausage-like links of vacuum sealed tube, or item of longitudinal structure formed by the continuous collapse of such exiting tube, would have to be of fairly limited length due to height restrictions. Due to height restrictions, the vertical systems are not preferred over the horizontal continuous centrifugal tube casting machines herein disclosed.

The vacuum seal means of FIG. 5 can also be used in conventional, non-centrifugal, vertical continuous casting of solid billets and can be used as means of applying Method 4 (a vacuum above the pool of molten metal being cast to billet) to this older continuous casting means. By application of such a vacuum, the hydrostatic forces on the mold side-wall can be reduced and the extraction rate speeded up.

The great advantage of the continuous centrifugal casting process disclosed herein concerns the rapid continuous casting of thinner tubular walls of high density material that has optimum integrity with a minimum of cross-sectional reduction by subsequent working (as rolling to structure).

FIG. 6 is a partial axial sectional view of a retractable plasma torch 71 confined within a vacuum sealing bellows 72 and located at the area 70 of the end plate seal 22. The purpose of the torch or torches is to preheat the refractory part 6 (of FIGS. 3 and 5) prior to start-up of the tube casting machine; and the bellows 72 is merely a means of maintaining the vacuum within the tube cavity 30 during extension for use and subsequent withdrawal (as shown in FIG. 6) out of the hot area of the cavity 30.

In FIG. 6, the annular flange 73 seats against the orifice lip 74 of the end plate 22 and acts as a heat-shield to prevent overheating of the bellows 72.

Figure 6A:
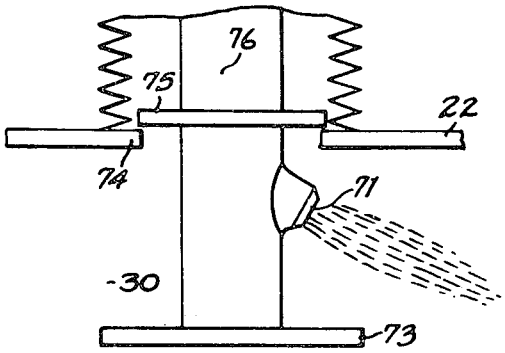

FIG. 6A shows the plasma torch 71 in the extended or use position and, in this case, the annular flange 75 seats against the orifice lip 74 and acts as the heat barrier. The plasma torch is encased in a refractory material 76 such as alumina.

Whereas the mechanism is shown in connection with the vertical casting system, it is also applicable to the horizontal systems of this disclosure.

STOPPING AND STARTING PROCEDURE

In stopping the machine, the axial travel of the tube extraction device (as gripped forging rolls 34 and 35 of FIGS. 3 and 4) is stopped by a suitable clutch mechanism (not shown) and the tube is allowed to rotate along with the centrifugal caster. Coincidental with the extraction stoppage, the input of molten material 2 is terminated and the tube 13 is allowed to solidify within the bore of the casting machine. Normally, the machine is kept rotating in any normal interval between stopping and starting of the tube casting. Once the tube extraction is stopped and the tube has solidified overall (including the heavy material section filling the annular trough 5), the positive pressure of inert gas (from the exit end 8 enclosure 40) will seep into the tube cavity 30 (as in FIGS. 3 and 4) via the crevice between the contracted tube wall O.D. and the mold wall I.D. Alternately and preferrably, once the seepage begins, the vacuum can be gradually broken by an inert gas purge via purge tube 25, the suction via tube 26 being stopped.

In starting up, from a normal rotating interim stop, the plasma torch 71 is inserted into the cavity 30 to its predetermined full extension and turned on so that its flame melts the solidified tube material in the annular trough 5. Once this has been accomplished, a desired vacuum is drawn on the cavity 30, a desired positive pressure is created in the end closure 40, the axial extraction is recommenced, and the appropriate amount of molten material 2 is continually introduced to the system. The plasma torch is then turned off and withdrawn as shown in FIG. 6.

If the centrifugal casting machine requires repairs in areas not covered by the tube 13, the rotation of the centrifuge may be stopped once the tube material within the bore of the centrifuge has completely solidified. After repairs have been made the start-up sequence is as previously noted.

In the instance where repairs or replacements have to be made to the mold 9 or the components of the refractory part 6, the cast tube is allowed to completely solidify in the bore of the machine while rotating, but without extracting the tube or adding molten material 2. See FIGS. 5–6A. Once solidification has been completed and the vacuum broken, the plasma torch 71 is inserted into the cavity 30 and turned on to quickly remelt the surface material 2 in the annular trough 5 and the torch is then turned off and withdrawn. The tube extracting mechanism is then brought into action and solidified tube is pulled out of the bore of the casting machine for subsequent use as a starter-blank. Once the tube blank is clear of the bore of the machine, rotation is stopped and the necessary repairs are made.

On start-up, the cast starting-blank is moved back into the bore of the caster (by any suitable reversing mechanism), an inert gas purge is made in the cavity 30, rotation is started up, the material in the trough 5 and part of the inserted end of the starting-blank is melted down with the plasma-torch, a vacuum is drawn on the cavity, a positive inert gas pressure is created in the enclosure 40, the plasma-torch is shut off and withdrawn, molten material 2 is continuously introduced via spout 4 and extraction is simultaneously commenced.

GRAIN REFINEMENT

In general, centrifugally cast metal tube is characterized by columnar grains extending radially inwards from the exterior surface. Such grain type is an advantage where the tube is used at elevated temperatures and pressures since a coarse-grained structure inhibits creep deformation. However, for most purposes, a fine grained material is desired due to its more favorable mechanical properties. Where the tube is collapsed and roll-sized to structure, such grain refinement can be accomplished due to the hot-working recrystallization. In the instance where the tube is to be used, as such (as for oil pipe, etc.), grain refinement can be accomplished either during the continuous centrifugal casting process or subsequent to its cooling to room temperature.

In the first instance (grain refinement coincident with tube casting), a shearing action can be set-up between the external shell of already solidified metal and the interior layer of still molten metal (as in area 14 of FIG. 3). This can be done by mechanical or magnetic means and the layer of still molten metal can be either slowed-down or speeded-up rotationally so that the still molten metal has a circumferential speed that is different from that of the already solidified exterior shell metal. In this manner, the shearing action at the solid-liquid interface destroys the columnar grain growth and creates an equiaxed fine grained structure in the solid tube metal.

Such differential rotational speed between the solid exterior shell and the inner still molten layer of metal can be caused by an interior refractory drum (of light, hollow construction and having an O.D. which is less-than the I.D. of the molten metal wall 12) which rotates either faster or slower than than the centrifuge and is driven by a cooled shaft extending through the stationary end seal plate 22. Such differential solid-liquid interface shear can also be created by a rotating magnetic flux internal to the centrifuged tube by an adaption of the method of Pestel as disclosed in U.S. Pat. No. 2,963,758 of 1960 when metal tube is being produced.

Grain refinement of the tube metal once it has exited from the casting machine can be accomplished by pulling the hot exiting tube through a rotating sizing bell or by drawing the tube, in the cold state, through non-rotating internal and/or external sizing dies which cold-work the tube metal while sizing it. Where discrete lengths of tube, having the ends sealed by forged closures, are made, a high pressure aperture can be made in one end and the tube length can be hydroforged as taught in U.S. Pat. No. 2,931,744. In both cases, where cold working is done on the tube metal, grain refinement is accomplished by subsequent reheating to its recrystallization temperature.

I claim:

1. Apparatus for continuous centrifugal casting of tube, comprising:

a generally tubular mold having an inlet end portion and an outlet end portion;

an exit orifice in said outlet end portion;

means for rotating said mold about is axis;

means for introducing molten casting material into said inlet end portion;

means for controlling the rate of exit of the cast tube from said exit orifice; and pressure means for maintaining a differential gas pressure lower in the interior of said tube than exterior thereto, said pressure means acting to decrease the expansion of said tube by rotational centrifugal forces and permits normal thermal shrinkage to decrease its diameter to facilitate its exit from said exit orifice.

2. Apparatus as in claim 1, further comprising the following inlet end portion sealing means:

a rotating sealing member attached to said inlet end portion of said mold and having a peripheral portion in the general shape of an annular trough with the open portion of said trough facing inwardly;

a liquid sealant in said trough maintained therein in the shape of an annular liquid sealing ring by rotational centrifugal force; and a stationary sealing wall member having a generally circular rim portion immersed in said annular liquid sealing ring, both said sealing members cooperating with said ring to form a substantially gas-tight seal between the interior and exterior of said mold.

3. Apparatus as in claim 2, wherein:

said stationary sealing wall member is generally disc-shaped, and is provided with apertures for access to the interior of said mold.

4. Apparatus as in claim 1, further comprising:

an annular enclosure encompassing said outlet end portion of said mold and the periphery of said tube outside said exit orifice;

enclosure seal means rotatably sealing said enclosure to the peripheries of said mold and said tube; and means for introducing a gas into said enclosure at a predetermined pressure, whereby said pressure acts on the exterior of said tube to at least partially counteract its expansion by the rotational centrifugal forces.

5. Apparatus as in claim 4, wherein:

said enclosure seal means comprises a plurality of individually movable refractory members disposed generally in the manner of an iris diaphragm to maintain sealing contact over a range of inner diameters.

6. Apparatus as in claim 4, wherein:

said enclosure seal means comprises a gas bearing to reduce friction between the rotating parts and the seal faces, the gas pressure in said gas bearing aiding substantially in maintaining the pressure in said enclosure.

7. Apparatus as in claim 4, wherein:

said enclosure seal means comprises a liquid bearing.

8. Apparatus as in claim 1, further comprising:

means for collapsing a portion of said tube after its exit from said mold to seal it and maintain said gas pressure.

* * * * *

UNITED STATES PATENT OFFICE

CERTIFICATE OF CORRECTION

Patent No. 3,930,532 Dated January 6, 1976

Inventor(s) George R. Leghorn

It is certified that error appears in the above-identified patent and that said Letters Patent are hereby corrected as shown below:

Column 3, after line 5, insert:

INCORPORATION BY REFERENCE

The following is incorporated into this specification by reference thereto: In my prior Patent No. 3,605,859, of which this is a division, Columns 1-12, and lines 1-17 of Column 13. This is the matter generally descriptive of the invention, including disclosure of the two variants of the novel method herein disclosed as follows:

Method 4.- By creating a vacuum, internal to the tube being cast, so as to partially or completely (depending on the wall thickness of the tube) counterbalance the centrifuged weight of the tube wall by the suction of the vacuum.

Method 5. - By raising the atmospheric pressure (exterior to the tube and the exit orifice of the centrifuge) by a desired amount over that of the ambient atmospheric

UNITED STATES PATENT OFFICE

CERTIFICATE OF CORRECTION

Patent No. 3,930,532 Dated January 6, 1976

Inventor(s) George R. Leghorn Page 2 of 2

It is certified that error appears in the above-identified patent and that said Letters Patent are hereby corrected as shown below:

pressure (14.7 p.s.i. is the average standard atmospheric pressure at sea-level) to create a counterbalancing force on the exterior of the tube to partially or completely counteract the centrifuged weight of the tube wall. Column 1, line 32, should read -- layering or smooth spreading out of the molten metal to --. Column 5, line 20, should read -- the O.D. of the centrifugal caster at its exit end 8) by --. Column 8, line 46, should read -- for oil line pipe, etc.), grain refinement can be accom- --. Claim 1, line 6, should read -- means for rotating said mold about it axis; --.

Signed and Sealed this

*first* Day of *June 1976*

[SEAL]

*Attest:*

RUTH C. MASON
*Attesting Officer*

C. MARSHALL DANN
*Commissioner of Patents and Trademarks*